US006580508B1

(12) United States Patent
Chen et al.

(10) Patent No.: US 6,580,508 B1
(45) Date of Patent: Jun. 17, 2003

(54) METHOD FOR MONITORING A SEMICONDUCTOR WAFER IN A CHEMICAL MECHANICAL POLISHING PROCESS

(75) Inventors: Hsueh-Chung Chen, Yungho (TW); Chien-Hung Chen, Hsin-Chu (TW); Juan-Yuan Wu, Hsin-Chu (TW)

(73) Assignee: United Microelectronics Corp., Hsin-Chu (TW)

( * ) Notice: Subject to any disclaimer, the term of this patent is extended or adjusted under 35 U.S.C. 154(b) by 0 days.

(21) Appl. No.: 09/449,533

(22) Filed: Nov. 29, 1999

(51) Int. Cl.[7] ..... G01N 21/55
(52) U.S. Cl. ..... 356/445
(58) Field of Search ..... 356/445, 357, 356/355, 381; 437/7, 225, 228

(56) References Cited

U.S. PATENT DOCUMENTS 4,953,982 A * 9/1990 Ebbing et al. ..... 356/357
4,998,021 A * 3/1991 Mimasaka ..... 250/560
5,190,614 A * 3/1993 Leach et al. ..... 156/626
5,433,651 A * 7/1995 Lustig et al. ..... 451/6
5,499,733 A * 3/1996 Litvak ..... 216/38
5,899,792 A * 5/1999 Yagi ..... 451/6
5,993,289 A * 11/1999 Allen et al. ..... 451/5
6,028,669 A * 2/2000 Tzeng ..... 356/355
6,045,439 A * 4/2000 Birang et al. ..... 451/526

* cited by examiner

*Primary Examiner*—Frank G. Font
*Assistant Examiner*—Michael P. Stafira
(74) *Attorney, Agent, or Firm*—Winston Hsu

(57) ABSTRACT

The present invention provides a monitoring method for monitoring a semiconductor wafer, in a chemical mechanical polishing (CMP) process. The CMP process is used to polish a dielectric layer of the semiconductor. The monitoring method comprises: 1. exposing the dielectric layer of the semiconductor wafer to an input light beam of fixed wavelength at a predetermined angle to generate a reflected light beam within a predetermined time period after performing the CMP process, the intensity of the reflected light beam undergoing periodic changes in response to the gradual thinning of the dielectric layer during the CMP process, 2. monitoring the intensity of the reflected light beam at a starting period within the predetermined time period and obtaining a periodic change rule according to the periodic changes of the intensity of the reflected light beam, and 3. monitoring the intensity of the reflected light beam throughout the rest of the predetermined time period and generating an output signal to stop the CMP process if the change of the intensity of the reflected light beam is not in accordance with the periodic change rule.

7 Claims, 3 Drawing Sheets

METHOD FOR MONITORING A SEMICONDUCTOR WAFER IN A CHEMICAL MECHANICAL POLISHING PROCESS

BACKGROUND OF THE INVENTION

1. Field of the Invention

The present invention relates to a method for monitoring a semiconductor wafer, and more particularly, to a method for monitoring a semiconductor wafer in a chemical mechanical polishing process.

2. Description of the Prior Art

In semiconductor processing, chemical-mechanical polishing (CMP) is a planarization technique for uniformly removing a deposited layer from the surface of a semiconductor wafer. When performing the CMP process, proper monitoring is essential to avoid any manufacturing or polishing errors that may affect the yield. In the prior art, a CMP end-point detection system uses an optical theorem to monitor the dielectric layer to decide when to stop polishing, i.e., the end-point of polishing. However, the prior art monitoring method is not continuous. It lacks the ability to know, at any given time, if the polishing process is complete or to standard. Consequently, if any mistakes occur before the end-point of the polishing is reached, there is insufficient time to stop the process.

In the prior art, a supporting stand is used during the CMP process. This stand comprises a pedestal for supporting the semiconductor wafer and a polishing pad installed on the pedestal for polishing the surface of the semiconductor wafer. There is a hole in the polishing pad. The stand is connected to a liquid transmitting system. The liquid transmitting system is responsible for directing the necessary polishing slurry to the stand for use in the CMP process. During CMP processing of the deposited layer, such as a dielectric layer, the semiconductor wafer is first positioned horizontally on the pedestal. The pedestal then spins at a certain speed. The polishing slurry is uniformly sprayed onto the surface of the spinning semiconductor wafer and undergoes chemical reactions with the dielectric layer. At the same time, the polishing pad above the pedestal presses downward upon the surface of the semiconductor wafer to perform a mechanical polishing. The chemical reaction of the polishing slurry in conjunction with the mechanical polishing of the polishing pad, and with the parameters of the process properly set, can remove the portion of the dielectric layer that lies on the surface of the semiconductor wafer. The end-point detection system determines the polishing end-point of the dielectric layer in the CMP process. This is accomplished by monitoring the reflected light beam from the dielectric layer via the hole in the polishing pad.

Please refer to FIG. 1. FIG. 1 is a graph of intensity versus time of the reflected light beam in a prior art method for monitoring a dielectric layer in a chemical mechanical polishing process. In the prior art method, the end-point detection system exposes the dielectric layer of the semiconductor wafer to an input light beam of fixed wavelength at a predetermined oblique angle to generate a reflected light beam that passes through the hole of the polishing pad when performing the CMP process. The intensity of the reflected light beam is detected. Measuring and recording the intensity of the reflected light beam continues at every time point. In FIG. 1, t2 in the figure denotes the predetermined point in time to stop the CMP process. The CMP process automatically stops at t2. However, as the polishing time increases, and before the time t2 is reached, the dielectric layer becomes thinner, which results in variations in the intensity of the reflected light beam. Such a change is depicted in the region between a time t1 and the predetermined end-point time t2, the region $\Delta t_2$. When the surface of the semiconductor wafer becomes excessively polished to the extent that the layer below the dielectric layer is reached, the intensity of the reflected light beam changes sharply due to the differences in the properties of the different materials. In order to avoid over-polishing, the CMP process must stop as soon as the sharp change of the intensity of the reflected light beam is discovered. So, in the prior art method of monitoring a semiconductor wafer in a chemical mechanical polishing end-point detection system, changes of the intensity of the reflected light beam within the time period $\Delta t_2$ are detected so as to determine the end-point of polishing of the dielectric layer and to monitor the accuracy of the CMP process.

The end-point detection system for a dielectric layer in the CMP process starts detecting at $t_1$ and stops detecting at $t_2$. Using the theorem of window logic, the change in the slope of the curve within a fixed window 19 at every time point within the time period $\Delta t_2$ is detected. If the change of the slope of the curve is larger than a predetermined value within the window 19, an output signal is generated to stop the CMP process. Alternatively, if the change of the slope of the curve is always smaller than the predetermined value, the CMP process will automatically stop at the end-point time $t_2$.

The prior art method does not detect the performance of the CMP process within the time period $\Delta t_1$, which is before the time point $t_1$. When errors in the CMP process occur within the time period $\Delta t_1$, they go undetected and an incorrect CMP process will continue to be performed on the semiconductor wafer. This may cause irreversible damage such that the semiconductor wafer must be discarded. This obviously affects the yield of the entire process.

SUMMARY OF THE INVENTION

It is therefore a primary objective of the present invention to provide a method for monitoring a semiconductor wafer in a chemical mechanical polishing process to solve the above mentioned problem.

In a preferred embodiment, the present invention provides a monitoring method for monitoring a semiconductor wafer in a chemical mechanical polishing (CMP) process, the CMP process being used to polish a dielectric layer of the semiconductor, the monitoring method comprising:

exposing the dielectric layer of the semiconductor wafer with an input light beam of fixed wavelength at a predetermined angle to generate a reflected light beam within a predetermined time period after performing the CMP process, the intensity of the reflected light beam undergoing periodic changes in response to the gradual thinning of the dielectric layer during the CMP process;

monitoring the intensity of the reflected light beam at a starting period within the predetermined time period and obtaining a periodic change rule according to the periodic changes of the intensity of the reflected light beam; and monitoring the intensity of the reflected light beam throughout the rest of the predetermined time period and generating an output signal if the change of the intensity of the reflected light beam is not in accordance with the periodic change rule.

It is an advantage of the present invention that the method for monitoring a semiconductor wafer in a chemical mechanical polishing process can detect the performance of the CMP process of a dielectric layer and prevent incorrect CMP processes, thereby improving productivity.

This and other objectives of the present invention will no doubt become obvious to those of ordinary skill in the art after having read the following detailed description of the preferred embodiment which is illustrated in the various figures and drawings.

DETAILED DESCRIPTION OF THE PREFERRED EMBODIMENT

Figure 1:
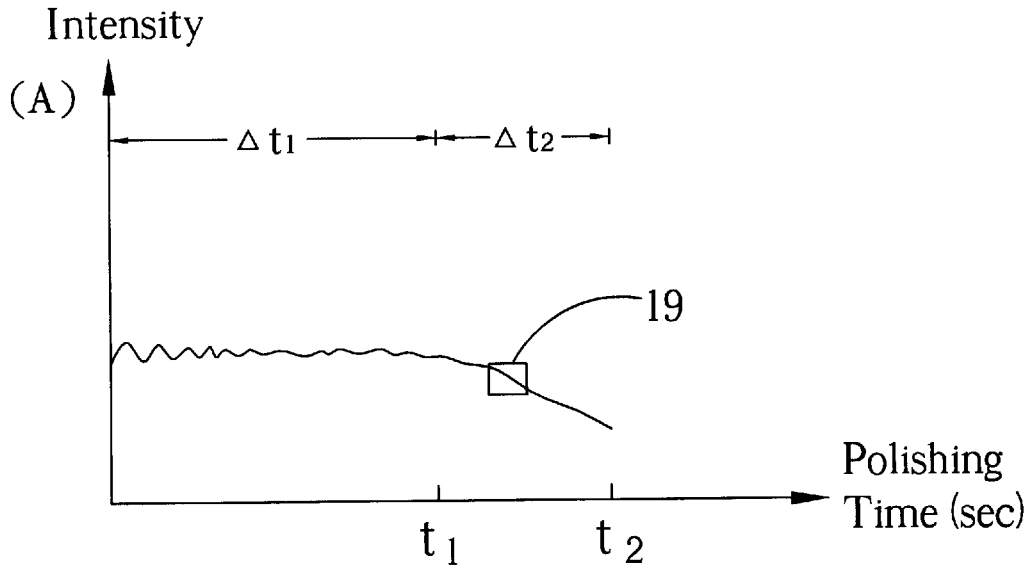
Fig. 1 Prior art
FIG. 1 is a diagram of the method for monitoring a dielectric layer in a chemical mechanical polishing process according to the prior art.
Figure 2:
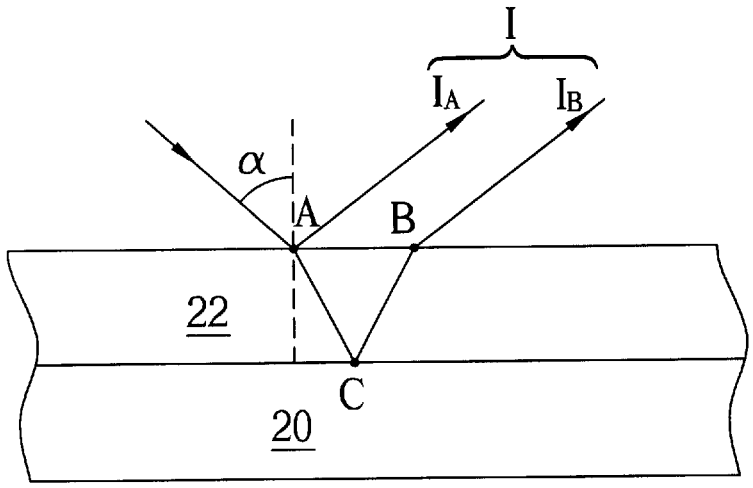
FIG. 2 and FIG. 3 are diagrams of the method for monitoring a semiconductor wafer in a chemical mechanical polishing process according to the present invention.
Figure 3:
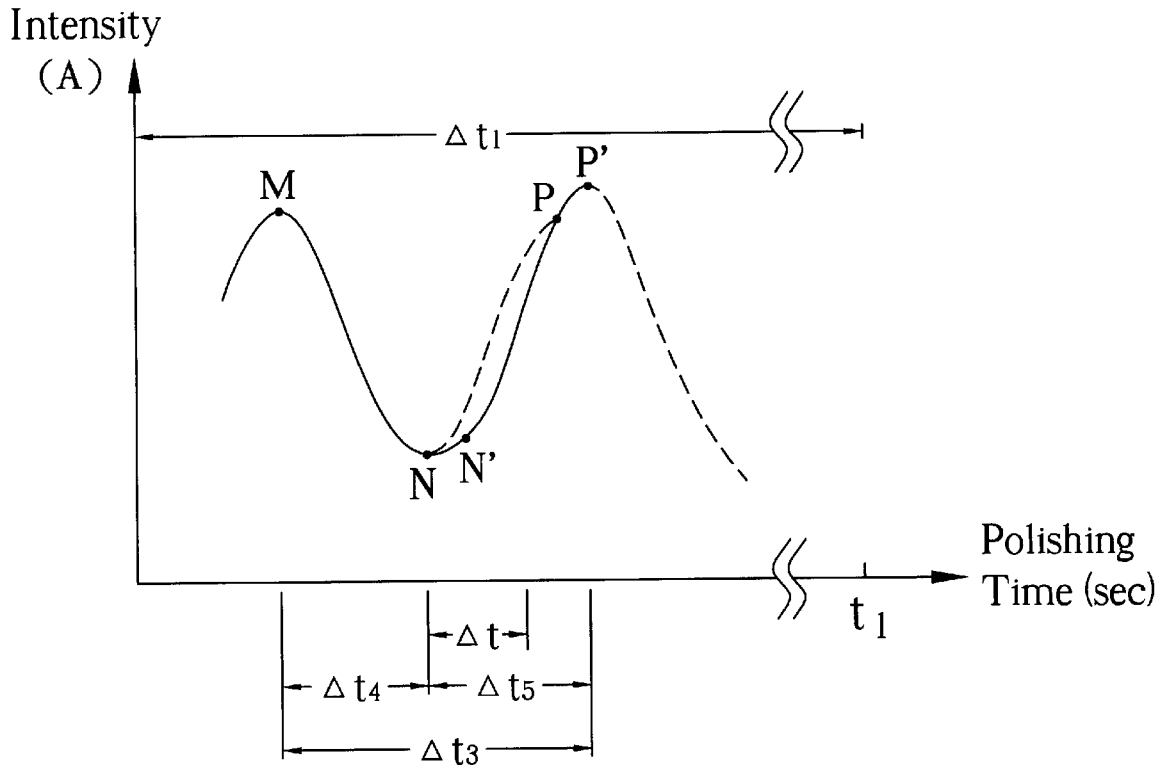

Please refer to FIG. 2 to FIG. 3. FIG. 2 and FIG. 3 are diagrams of the method for monitoring a semiconductor wafer in a chemical mechanical polishing process according to the present invention. The prevent invention method is used to monitor a semiconductor wafer 20 in a CMP process within a time period $\Delta t_1$. The semiconductor wafer 20 comprises a dielectric layer 22 on the surface of the semiconductor wafer 20. The CMP process is performed using the prior art polishing stand. The polishing pad presses downward upon the surface of the dielectric layer 22 and mechanically polishes it down to a predetermined thickness. In the present invention method, the dielectric layer 22 of the semiconductor wafer 20 is exposed to an input light beam of fixed wavelength at a predetermined oblique angle $\alpha$ via the hole of the polishing pad to generate a reflected light beam at a reflected angle corresponding to the oblique angle $\alpha$ within a predetermined time period $\Delta t_1$ while performing the CMP process. Within the time period $\Delta t_1$, a predetermined sampling frequency is used to record the detected intensity of the reflected light beam to form a curve that relates the intensity of the reflected light beam to time so as to monitor the polishing status of the dielectric layer 22.

As shown in FIG. 2, according to optical theorems, within the time period $\Delta t_1$, the intensity I of the reflected light beam reflected from the surface of the semiconductor wafer 20 in a correct CMP process comprises an intensity $I_A$ of the light beam reflected from point A on the surface of the dielectric layer 22 and an intensity $I_B$ of the light beam reflected from point C on the bottom surface of the dielectric layer 22. The light reflected from point A corresponding to the intensity $I_A$ and the light refracted through point A to point C and then reflected back to point B corresponding to the intensity $I_B$ will have a phase difference $\phi$. Using the formula, $$I=I_A+I_B+2(I_A\times I_B)^{1/2}\cos(\phi) \quad (1)$$

as the dielectric layer 22 becomes thinner, the intensity I of the reflected light beam undergoes periodic changes such that the curve describing the intensity of the reflected light beam versus time is similar to a cosine wave.

As shown in FIG. 3, $\Delta t_3$ is equal to one period of the cosine wave. In the present invention monitoring method, the intensity of the reflected light beam within a period $\Delta t_3$ of the time period $\Delta t_1$ is monitored and recorded and a periodic change rule according to the periodic change of the intensity of the reflected light beam is obtained. The recorded change of the intensity I of the reflected light at a starting period $\Delta t_4$ within the time period $\Delta t_3$ forms a measured curve MN. The measured curve MN can be used to predict the change of the curve within next period $\Delta t_5$, i.e. a theoretical curve NP. Monitoring of the intensity I of the reflected light beam within a time period $\Delta t_5$ continues and the change of intensity I of the reflected light beam at each time point is calculated so as to form a measured curve N'P' within the time period $\Delta t_5$ to compare with the theoretical curve NP.

This embodiment compares the phase difference between the measured curve N'P' and the theoretical curve NP as an index of the correctness of polishing.

The calculation of the phase of the measured curve N'P' is as follows: Assume the relationship of the intensity I of the reflected light and the phase $\phi$ rigorously obeys the formula (1). Then, if the relative values of $I_A$ and $I_B$ are known, the phase $\phi$ can be calculated from the measured value of I.

Within the time period $\Delta t_4$, the measured curve MN is recorded. There is a maximum value of the intensity I of the reflected light, denoted as $I_{max}$, ($\phi=m\pi$, m=0, 2, 4, . . . )

$$I_{max}=I_A+I_B+2(I_A\times I_B)^{1/2} \quad (2)$$

And there is a minimum value denoted as $I_{min}$, ($\phi=n\pi$, n=1, 3, 5, . . .

$$I_{min}=I_A+I_B-2(I_A\times I_B)^{1/2} \quad (3)$$

Assume within the next time period $\Delta t_5$ (a half period), the maximum value and the minimum value are the same as those within time period $\Delta t_4$. Then the phase $\phi_{\Delta t}$ of the measured curve at the time point t (time period $\Delta t$ after the point N) can be calculated from formula (4):

$$I_{\Delta t}=I_A+I_B+2(I_A\times I_B)^{1/2}\cos(\phi_{\Delta t}) \quad (4)$$

wherein $I_A+I_B=(I_{max}+I_{min})/2(I_A*I_B)^{1/2}=(I_{max}-I_{min})/4$ then $\phi_{\Delta t}=\cos^{-1}((4I_{\Delta t}-2(I_{max}+I_{min}))/(I_{max}-I_{min})), 0<\phi_{\Delta t}<\pi$.

The phase $\phi_{\Delta t,th}$ of the theoretical curve NP at the time point t can be calculated from formula (5):

$$\phi_{\Delta t,th}=\pi\times\Delta t/\Delta t_4 \quad (5)$$

If the difference of the these two phases $\phi_{\Delta t,th}$ and $\phi_{\Delta t}$ is defined as $\Delta\phi$, then $\Delta\phi$ can be used as an index of correctness of polishing. After passing a new extremum, $I_{max}$ and $I_{min}$ are renewed so as to calculate the phase of the next half period.

When the phase difference between the measured curve N'P' and the theoretical curve NP at each corresponding point is smaller than a predetermined predictable deviation $\pi/10$, the CMP process of the semiconductor wafer 20 is correct within the time period $\Delta t_5$, and the measured curve N'P' can be used to predict the theoretical curve at the next time period. Use of this method proceeds, continuing to detect deviations of the phase difference between the measured curve and the theoretical curve. Once the measured intensity of the reflected light does not match to within tolerance of the predicted theoretical curve, the CMP process is incorrect. An output signal is then generated to stop the CMP process so as to prevent the semiconductor wafer 20 from further undergoing an incorrect CMP process.

The present invention monitoring method follows the periodic changes of the intensity of the reflected light within time a period $\Delta t_1$ to calculate the phase difference between the theoretical curve and the measured curve so as to monitor the polishing status of the dielectric layer 22 of the semiconductor wafer 20. Within the time period $\Delta t_1$, if an incorrect CMP process is performed due either to human error or for any other reason, the present invention monitoring method can generate an output signal in time to stop the incorrect CMP process.

Figure 4:
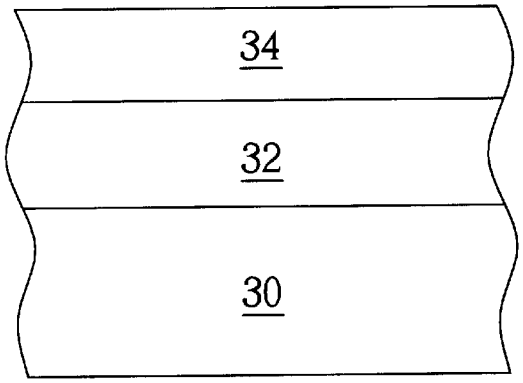
FIG. 4 and FIG. 5 are diagrams of an alternative method for monitoring according to the present invention.
Figure 5:
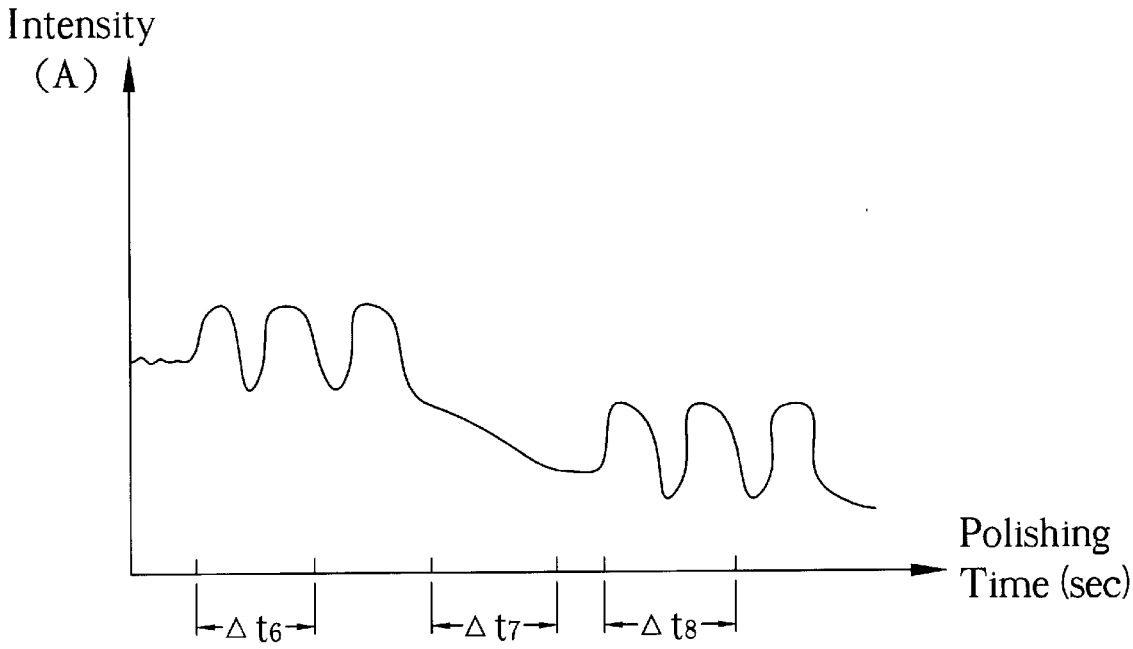

Please refer to FIG. 4 and FIG. 5. FIG. 4 and FIG. 5 are diagrams of an alternative method for monitoring according to the present invention. The present invention monitoring method can be used in the CMP process of polishing dielectric layers made of two different materials. The semiconductor wafer 30 comprises a first dielectric layer 32 on the surface of the semiconductor wafer 30, and a second dielectric layer 34 on the surface of the first dielectric layer 32. The CMP process is used to polish the surface of the semiconductor wafer 30 to remove the second dielectric layer 34 and the first dielectric layer 32 sequentially. The present invention monitoring method can be used to monitor the status of the second dielectric layer 34 being polished and remind the operator at the proper time to change the related parameters of the processes. On continuing, the status of the first dielectric layer 32 being polished can then be monitored. When performing the CMP process on the semiconductor wafer 30, the present invention monitoring method is used to monitor the status of the second dielectric layer 34 being polished within a predetermined time period $\Delta t_6$, and in conjunction with the prior art window logic detecting method, to determine the end-point of the CMP process of the second dielectric layer 34 within a predetermined time period $\Delta t_7$, so as to inform the operator to change the related parameters of the process to perform the CMP process on the first dielectric layer at the proper time. Within a predetermined time period $\Delta t_8$ after performing the CMP process on the first dielectric layer, the present invention monitoring method can be used again to monitor the status of the first dielectric layer 32 being polished. Hence, the present invention monitoring method can be used to monitor the CMP process of the semiconductor wafer 30 with two dielectric layers 32, 34, so that when processing errors occur, an output signal is generated to stop the incorrect CMP process.

Compared to the monitoring method of the prior art, in the present method for monitoring a semiconductor wafer in a chemical mechanical polishing process, the dielectric layer 22 of the semiconductor wafer 20 is exposed to an input light beam of fixed wavelength at a predetermined angle to generate a reflected light beam within a predetermined time period $\Delta t_3$ after performing the CMP process. Then, by monitoring the change of the intensity of the reflected light beam at a starting period $\Delta t_4$ within the predetermined time period $\Delta t_3$, the periodic change rule of the intensity of the reflected light beam is calculated to produce the theoretical curve for comparison against the measured curve. When the measured curve does not match the periodic change rule of the theoretical curve, an output signal is generated to stop the CMP process. So, the present invention monitoring method can closely monitor the status of the dielectric layer 22 of the semiconductor wafer 20 being polished and generate an output signal in time to stop the CMP process whenever processing errors occur. This further increases the process yield.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A monitoring method for monitoring a semiconductor wafer in a chemical mechanical polishing (CMP) process, the CMP process being used to polish a surface of a dielectric layer formed on the semiconductor wafer, the monitoring method comprising:

exposing the surface of the dielectric layer to an input light beam of fixed wavelength at a predetermined angle to generate a reflected light beam within a predetermined time period $\Delta t_3$ after performing the CMP process, the intensity of the reflected light beam undergoing periodic changes that are sinusoidal within the predetermined time period $\Delta t_3$ in response to the gradual thinning of the dielectric layer during the CMP process;

monitoring and recording the intensity of the reflected light beam at a starting period $\Delta t_4$ within the predetermined time period $\Delta t_3$ to generate a first measured intensity versus time curve having a maximum intensity value $I_{max}$ at a time point $t_3$ and a minimum intensity value $I_{min}$ at a time point $t_4$, wherein $\Delta t_4$ equals the time period from $t_3$ to $t_4$;

analyzing the first measured intensity versus time curve to predict a theoretical intensity versus time curve having a theoretical phase $\phi\Delta t$,that any time point t between the time point $t_4$ and a time point $t_5$, wherein $\Delta t_3$ equals the time period from $t_3$ to $t_5$;

monitoring and recording the intensity of the reflected light beam from the time point $t_4$ to the time point $t_5$ to generate a second measured intensity versus time curve having a phase $\phi_{\Delta t}$ at any time point t between the time point $t_4$ and the time point $t_5$, wherein $0<\phi_{\Delta t}<\pi$; and stopping the CMP process if the difference of the phase $\phi_{\Delta t,th}$ and the phase $\phi_{\Delta t}$ at each corresponding time point is greater than or equal to a predetermined tolerance;

wherein the length of the predetermined time period $\Delta t_3$ is equal to one predetermined period of the periodic changes.

2. The monitoring method of claim 1 wherein the predetermined tolerance is $\pi/10$.

3. The monitoring method of claim 1 wherein the theoretical phase $\phi_{Ät}$t,that any time point t between the time point $t_4$ and a time point $t_5$ is calculated from the following formula:

$$\phi_{Ät,th}=\pi\times Ät/Ät_4$$

wherein Ät equals the time difference between the time point t and the time point $t_4$.

4. The monitoring method of claim 1 wherein the phase $\phi$ Ätat any time point t between the time point $t_4$ and the time point $t_5$ of the second measured intensity versus time curve is calculated from the following formula:

$$\phi_{Ät}=\cos^{-1}((4I_{Ät}-2(I_{max}+I_{min}))/(I_{max}-I_{min}))$$

wherein $I_{Ät}$equals the measured intensity value at the time point t.

5. The monitoring method of claim 4 wherein the intensity of the reflected light beam at the starting period $Ät_4$ is recorded at a predetermined sampling frequency that is controlled by adjusting the rotating speed of a polishing pad.

6. The monitoring method of claim 5 wherein after passing a new extreme, $I_{max}$ and $I_{min}$ are renewed so as to calculate the phase of the next half period, and the second measured intensity versus time curve is used to predict a new theoretical intensity versus time curve at the next time period.

7. The monitoring method of claim 1 wherein the input light beam is a laser beam of a fixed wavelength striking the surface of the dielectric layer at a predetermined oblique angle via a hole in a polishing pad to generate the reflected light beam at a reflected angle corresponding to the oblique angle within a predetermined time period $Ät_1$ while performing the CMP process.

* * * * *